United States Patent [19]

Moriyama

[11] Patent Number: 5,070,648

[45] Date of Patent: Dec. 10, 1991

[54] WINDOW REGULATOR FOR AUTOMOTIVE VEHICLE

[75] Inventor: Yukihiro Moriyama, Hiroshima, Japan

[73] Assignee: Mazda Motor Corporation, Hiroshima, Japan

[21] Appl. No.: 483,380

[22] Filed: Feb. 22, 1990

[30] Foreign Application Priority Data

Feb. 22, 1989 [JP] Japan ..... 1-43451

[51] Int. Cl.[5] ..... E05F 11/48

[52] U.S. Cl. ..... 49/352; 49/227; 49/349; 49/502

[58] Field of Search ..... 49/352, 350, 351, 349, 49/374, 502, 227

[56] References Cited

U.S. PATENT DOCUMENTS

| | | | |
|---|---|---|---|
| 4,633,613 | 1/1987 | Kobayashi et al. | 49/352 X |
| 4,660,325 | 4/1987 | Bauer et al. | 49/352 |
| 4,669,221 | 6/1987 | Ugawa et al. | 49/352 |
| 4,669,222 | 6/1987 | Ujihara et al. | 49/352 X |
| 4,691,475 | 9/1987 | Maekawa | 49/352 |
| 4,727,681 | 3/1988 | Kinoshita et al. | 49/352 |
| 4,730,414 | 3/1988 | Nakamura et al. | 49/352 |
| 4,905,412 | 3/1990 | Srock et al. | 49/352 |

FOREIGN PATENT DOCUMENTS

| | | | |
|---|---|---|---|
| 61-250279 | 11/1986 | Japan . | |
| 273115 | 11/1987 | Japan | 49/352 |

*Primary Examiner*—Gary L. Smith
*Assistant Examiner*—Michael Mano
*Attorney, Agent, or Firm*—Fleit, Jacobson, Cohn, Price, Holman & Stern

[57] ABSTRACT

A window regulator for moving a window glass up or down so as to open or close a window of an automotive vehicle door having two guide rails substantially vertically disposed and horizontally spaced in parallel with each other and two sliding members secured to the window glass and mounted on the two guide rails, respectively, for sliding movement. One of the two sliding members is vertically spaced above the other of the two sliding members and caused to slidingly move up or down along the guide rail, thereby moving the window glass up or down so as to close or open the window of the automotive vehicle door.

5 Claims, 7 Drawing Sheets

WINDOW REGULATOR FOR AUTOMOTIVE VEHICLE

The present invention relates to a window regulator for an automotive vehicle, and more particularly to a window regulator in which a window glass is slidably guided by parallel guide rails to move up and down.

BACKGROUND OF THE INVENTION

A window regulator for an automotive vehicle has a plurality of guide rails in a space located between inner and outer door panels of a door, which guide rails are disposed in parallel with one another so as to provide substantially vertical up and down movement of a window glass, so that the window glass moves in and out of the door. The guide rails, respectively, slidably mount thereon sliders which interconnect by an X-link or a cable the window glass and either a power operated device or a manually operated device. A driving force from the power or manual operating device acts on the window glass at a point where the slider secures the window glass.

To avoid the window glass of a sashless door from inclining inwardly or outwardly with respect to the sashless door during upward movement of the window glass, it has been proposed to extend the guide rails to a triangular corner of a door window opening of the door. Such a window regulator is known from Japanese Unexamined Patent Publication No. 61(1986)-250279.

A drawback to the use of such window regulators for, in particular, sashless doors is that the window glass, in addition to inward or outward inclination, is often subjected to tilting back and forth when the window glass is moved up or down, which has the effect of impeding a smooth opening and closing motion of the window. This is because there is a design requirement according to an automotive body appearance that the window glass of an automotive door window has a slight inward inclination toward a vehicle compartment. When guide rails for guiding up and down movement of the window glass are vertically inclined, a moving path or trajectory is unavoidably complicated to move the window glass diagonally and, due to the complexity of the moving path, the window glass is imbalanced and the center of gravity of the window glass moving up or down changes in position, resulting in a stiff motion called a slip and stick motion.

SUMMARY OF THE INVENTION

It is, therefore, a primary object of the present invention to provide a window regulator for an automotive vehicle door which moves the window glass up and down.

The above object of the present invention is achieved by providing a window regulator of an automotive vehicle door which smoothly moves a window glass up and down to open and close the window of the automotive vehicle door. The window regulator comprises two guide rails substantially vertically disposed and horizontally spaced in parallel with each other in the door and sliding means secured to the window glass and slidably supported at at least two points by the two guide rails for sliding movement. The supporting points are vertically spaced from each other. At one supporting point which is above the other supporting point the sliding means is applied with a driving force by driving means to slidingly move up or down along the guide rails, thereby moving the window glass up or down so as to close or open the window of the door. The sliding means desirably comprises two sliding members mounted on the guide rails, respectively and one of the two sliding members is vertically spaced above the other of the two sliding members.

The arrangement of one slider vertically spaced above the other slider, which acts as a traction or leading slider, allows to provide a large angle between a line interconnecting the two sliders along a line which the other slider moves according to whatever door design conditions may be required. Providing a large angle between the two lines allows the two guide rails to be spaced at a large distance D, thereby setting the distance E between the two sliders so as to hold the window glass dynamically balanced and to thereby allow the window glass to move up and down without a slip and stick motion.

BRIEF DESCRIPTION OF THE DRAWINGS

The above and other objects and features of the present invention will be apparent from the following description of preferred embodiments thereof when taken in conjunction with the appended drawings, in which same or similar parts are designated by the same reference numerals throughout several drawings and wherein.

DETAILED DESCRIPTION OF THE PREFERRED EMBODIMENTS

Figure 1:
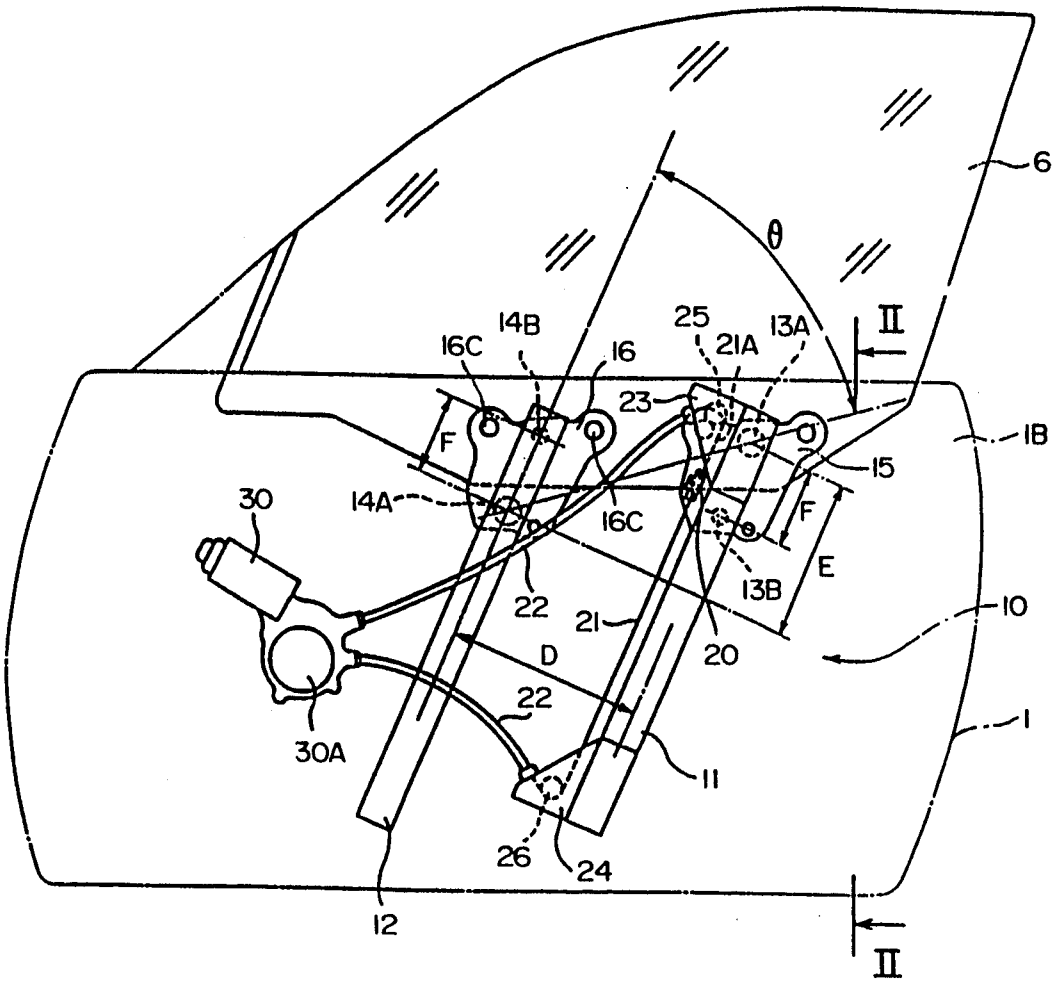
FIG. 1 is a schematic illustration of a sashless door of an automotive vehicle incorporating a window regulator in accordance with a preferred embodiment of the present invention.
Figure 2:
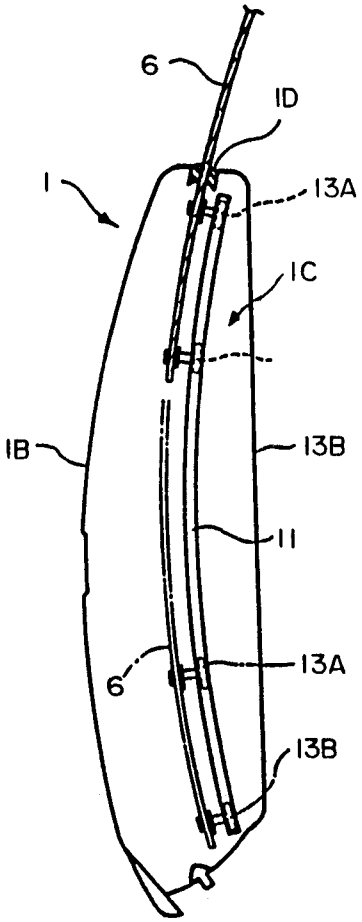
FIG. 2 is a cross-sectional view taken along line II—II in FIG. 1.
Figure 3:
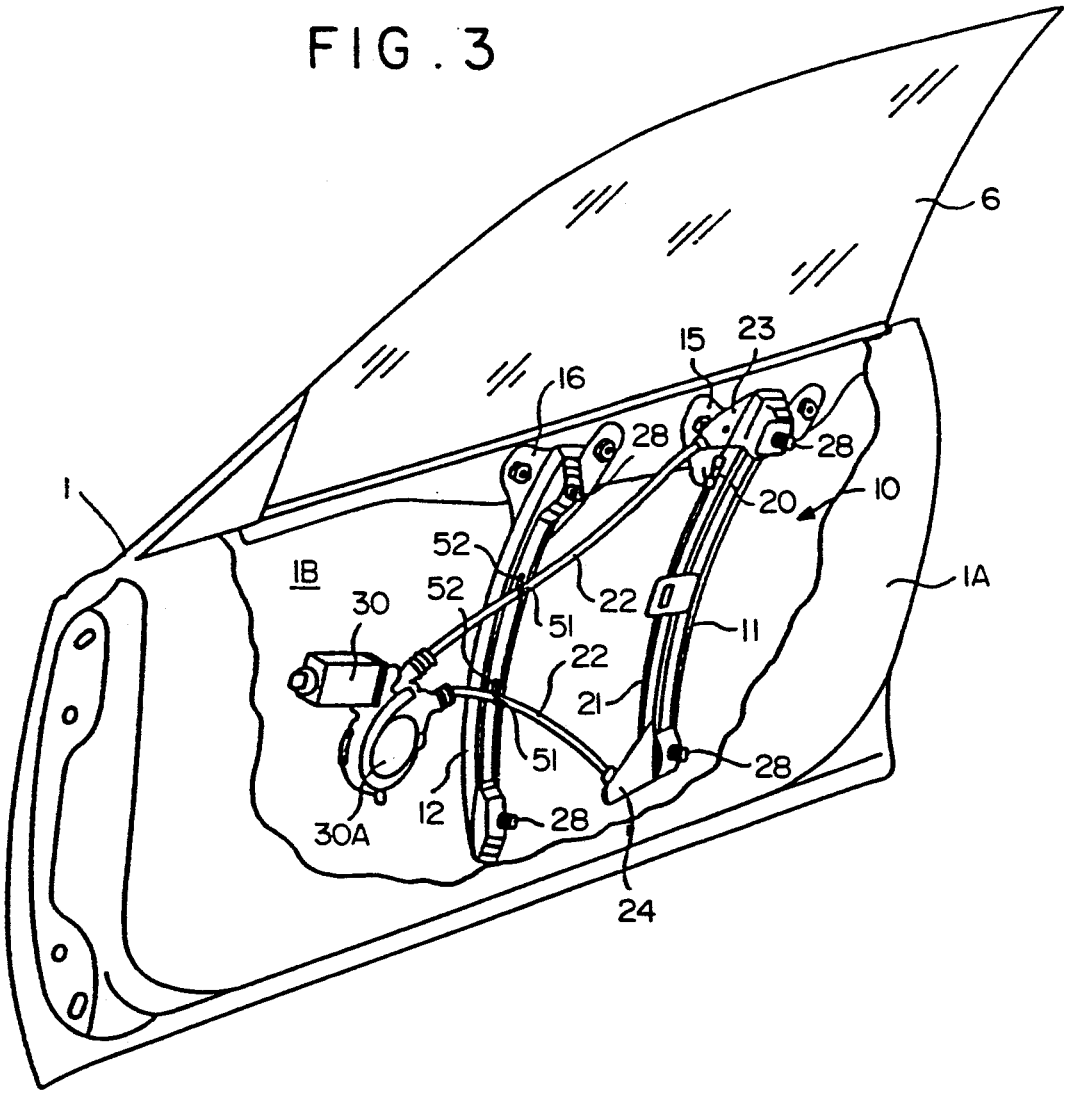
FIG. 3 is a perspective view of the door, with an inner door panel partly broken away, shown in FIG. 1.
Figure 4:
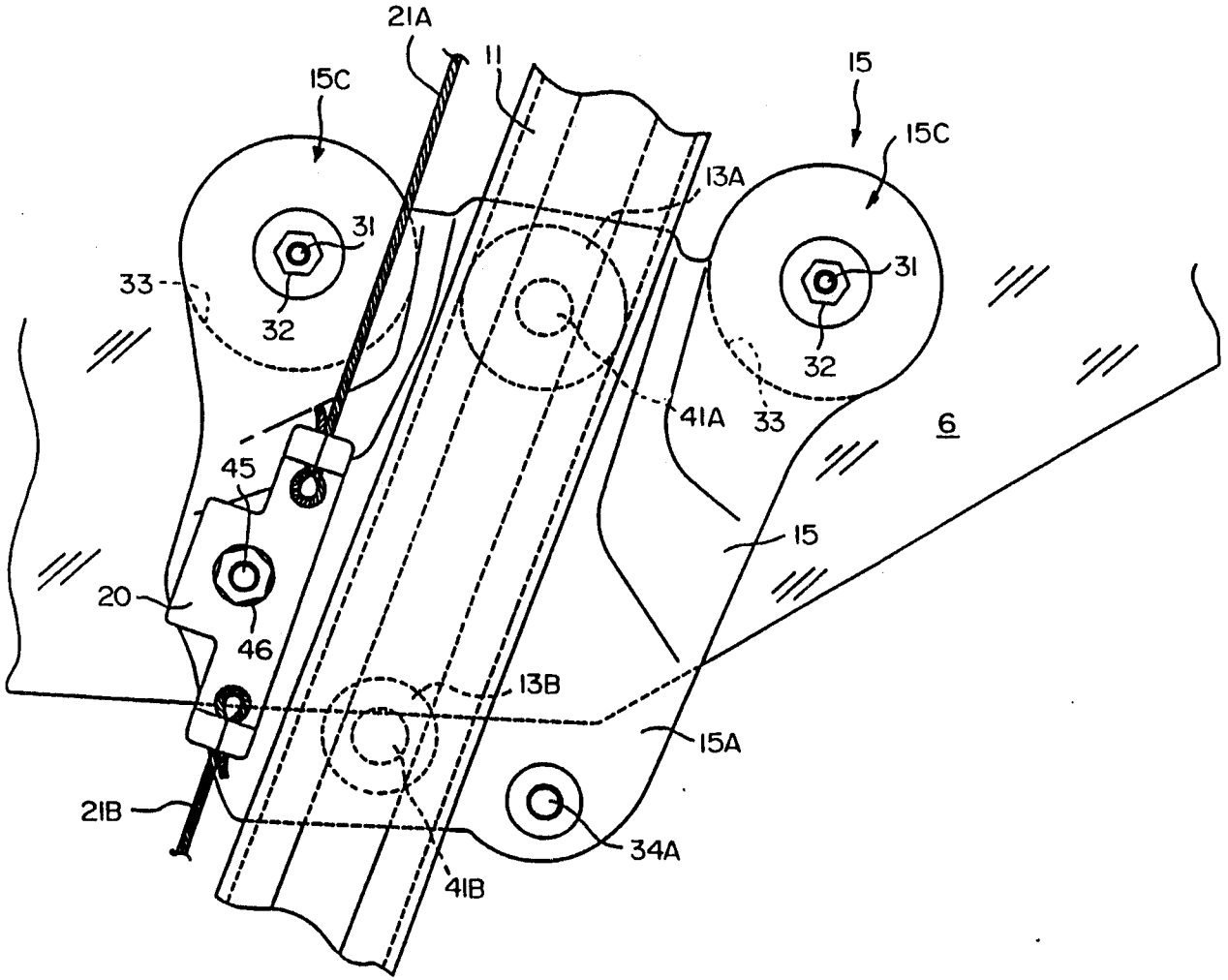
FIG. 4 is a front view of a bracket of the window regulator.

Referring to the drawings in detail, in particular to FIGS. 1 to 3, a sashless front door 1 having a window regulator generally designated by a reference numeral 10 in accordance with a preferred embodiment of the present invention is shown, comprising inner and outer door panels 1A and 1B connected to each other to form therebetween a space 1C in which the window regulator 10 is incorporated and which the window glass 6 goes in and out through a window slot 1D. The window regulator 10 is provided with first or front and second or rear guide rails 11 and 12, each of which is, as described in detail later, formed in the shape of a boxed channel with a slot. These guide rails 11 and 12 are secured to the inner door panel 1A with fastening bolts 28 and arranged in parallel with each other with their axes tilted slightly rearward. The first and second guide rails 11 and 12, in addition to being inclined rearward, are curved inwardly as viewed from the inner door panel 1A as is clearly shown in FIGS. 2 and 3. First and second sliders 13A and 14A, each of which is shaped in the form of a roller and, respectively, attached to first and second brackets 15 and 16 are, on one hand, slidably mounted on the first and second guide rails 11 and 12, respectively, and, on the other hand, secured to a lower part of a window glass 6. It is to be noted that the first and second sliders 13A and 14A are horizontally offset in a direction in which they move in such a way that the first is positioned above the second by a distance E. The first bracket 15 of the upper positioned first slider 13A is provided near its upper end with a cable retainer 20 to which is secured a cable 21 which is stretched between upper and lower pulleys 25 and 26 rotatably mounted on brackets 23 and 24 secured to upper and lower ends of the first guide rail 11 and a power transmission 30A power driving device, such as an electric motor 30 secured to the inner door panel 1A. In this sense, the first slider 13A is referred to as a traction or leading slider.

The first bracket 15 of the first slider 13A comprises inner and outer bracket plates 15A and 15B spaced apart from each other to form a space therebetween for receiving therein a lower portion of the window glass 6. The outer bracket 15B is provided at its lower end with a generally L-shaped support 19 for receiving therein a U-shaped cushion 18 made of an elastic material, such as rubber, attached to a lower margin of the window glass 6. The first bracket 15 forms at its upper portion two window glass fixtures 15C for fixing the lower portion of the window glass 6 interposed between the inner and outer bracket plates 15A and 15B with fastening bolts 31 and nuts 32. The window glass fixture 15C comprises a hole 6A formed in the window glass 6 whose diameter is larger than the diameter of the fastening bolt 31 and collared annular rings or grommets 33 made of plastic materials covering marginal portion of the window glass 6 around the hole 6A and the inner surface of the hole 6A. By fastening the fastening bolt 31, the inner and outer bracket members 15A and 15B are tightened so as to firmly hold the window glass 6 interposed therebetween through the grommets 33. The first bracket 15 is further provided at its lower end with an angle adjuster for adjusting an inward inclination of the window glass 6 in a manufacturing stage. The angle adjuster comprises an adjusting screw 34 having a stem 34A rotatably mounted on the lower end of the outer bracket plate 15B and a nut 35 fixed to the lower end of the inner bracket plate 15A. The adjusting screw 34 is engaged with the nut 35 and fastened or loosened to change the inclination of the outer bracket plate 15B with respect to the inner bracket plate 15A. Because of the larger diameter of the hole 6A than that of the fastening bolt 31, fastening or loosening the adjusting screw 34 causes the window glass 6 to change its inclination with respect to the inner and outer door panels 1A and 1B of the door 1. After the adjustment of the inclination of the window glass 6, the head of the adjusting screw 34 is crushed to rivet the outer bracket plate 15B in position.

Figure 9:
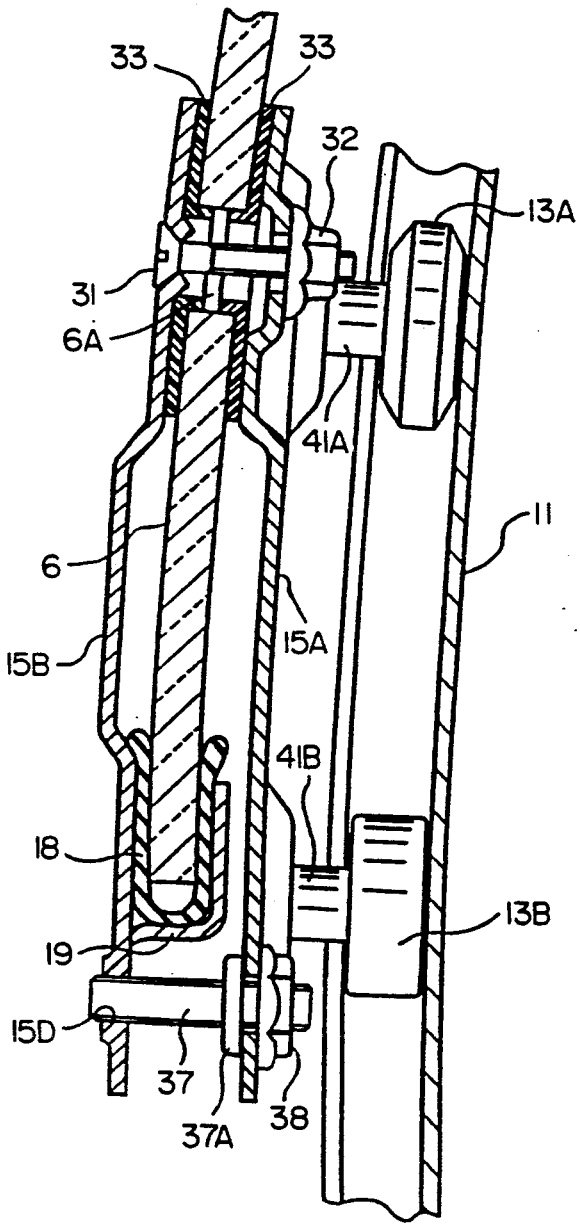
FIG. 9 is a cross-sectional view similar to FIG. 5 showing a different type of angle adjuster.

The angle adjuster may be of another type of adjusting screw 37 having an annular flange 37A engaged with a threaded hole 15D of the outer bracket plate 15B. As shown in FIG. 9, the flange 37A of the adjusting screw 37 is in contact with the inner bracket plate 15A. Turning the adjusting screw 37 forces or loosens the outer bracket plate 15B, so as to change the inclination of the outer bracket plate 15B, and hence the window glass 6, with respect to the inner bracket plate 15A. After adjustment of the inclination of the window glass 6, a lock nut 38 is fastened to the adjusting screw 37 on the side of the inner door panel 1A, thereby preventing the adjusting screw 37 from further rotation.

Figure 6:
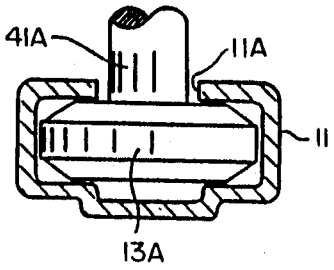
FIG. 6 is a cross-sectional view of a slider in a guide rail of the window regulator.
Figure 7:
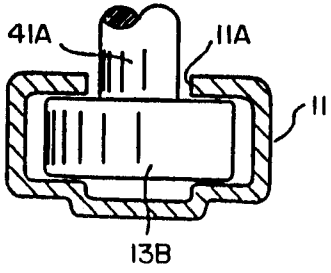
FIG. 7 is a cross-sectional view of an auxiliary slider in the guide rail of the window regulator.

The inner bracket plate 15A of the first bracket 15 is provided with upper and lower shafts 41A and 41B separated by a distance F from each other for mounting thereon the first slider 13A and a first auxiliary slider 13B for rotation. The first guide rail 11, which is fashioned in a boxed channel with a slot 11A, snugly receives the first slider 13A therein and the upper shaft 41A in the slot 11A so as to allow them to move smoothly up and down as shown in FIG. 6. The first guide rail 11 further receives therein, but loosely, the second auxiliary slider 13B and the lower shaft 41B in the slot 11A so as also to allow them to move smoothly up and down as shown in FIG. 7.

The second bracket 16 of the second guide rail 12 is similar in structure to the first bracket 15 and comprises inner and outer bracket plates spaced apart from each other to form a space therebetween for receiving therein a lower portion of the window glass 6. The second bracket 16 is formed at its upper portion with two window glass fixtures 16C which have the same structure as those of the first bracket 15, for securing the lower portion of the window glass 6 interposed between the inner and outer bracket plates with fastening bolts and nuts (not shown).

The inner bracket plate of the second bracket 16 mounts thereon the second slider 14A and a second auxiliary slider 14B spaced apart by the distance F for rotation. The second guide rail 12, which has the same fashion as the first guide rail, snugly receives the second slider 14A therein so as to allow the second slider to move smoothly up and down. The second guide rail 12 further receives, but loosely, the second auxiliary slider 14B therein so as also to allow the second auxiliary slider to move smoothly up and down.

Because of the shape of the first and second sliders 13A and 14A so formed as to snugly fit in the channel of the first and second guide rails 11 and 12, respectively, the window glass 6 moves up and down without inclining inwardly or outwardly. Furthermore, the arrangement of the sliders 13A, 13B, 14A and 14B which are located at the respective vertices of a parallelogram contributes to the smooth moving of the window glass 6 up and down without any back and forth tilt.

Figure 8:
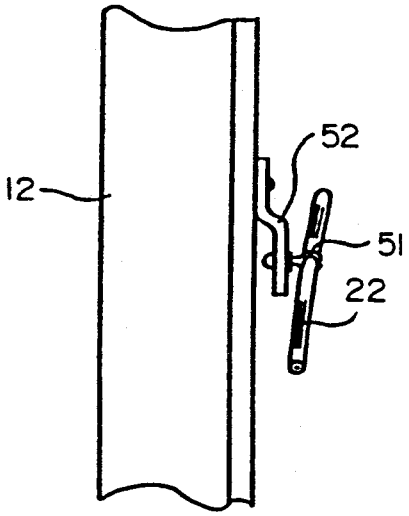
FIG. 8 is an illustration showing a cable clip for supporting a cable.
Figure 5:
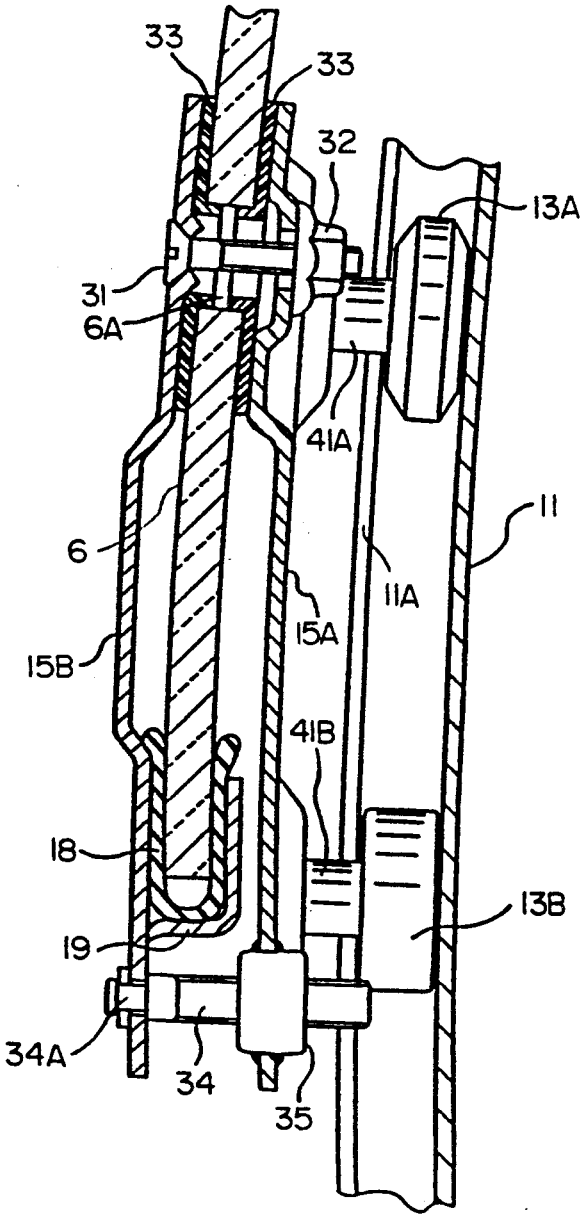
FIG. 5 is a cross-sectional view of FIG. 4.

The cable retainer 20, secured to an upper front edge of the inner bracket plate 15A of the first bracket 15 with a fastening bolt 45 and a nut 46, engages both ends 21A and 21B of the cable 21. The cable 21, which is partly received in and covered by a flexible tube 22, is looped between the upper and lower pulleys 25 and 26 and is operationally coupled to the power transmission 30A of the electric motor 30. As shown in FIG. 8 in detail, the flexible tube 22 is held by several clips 51 mounted on brackets 52 secured to the second guide rail 12 so as to be prevented from swinging. The electric motor 30 moves the cable retainer 20 up when rotating in one direction or moves it down when rotating in the opposite direction.

In the operation of the window regulator 10 in accordance with the preferred embodiment of the present invention, when actuating the electric motor 30 in the one direction to move the window glass 6 up so as to close the window of the door 1, the cable retainer 20 is pulled up by the cable 21 to slidingly move the first slider 13A up along the first guide rail 11, thereby pushing the window glass 6 up in a direction parallel to the first guide rail 11. As the window glass 6 moves up, it pulls up the second slider 14A placed horizontally below the first slider 13A along the second guide rail 12. The movement of the second slider 14A following to and parallel to the movement of the first slider 13A allows the window glass 6 to smoothly move up without a stiff motion or slip and stick motion. This is because, the first and second sliders 13A and 14A are spaced apart from each other at a sufficiently large distance E in the direction in which they move in order to hold the window glass 6, keeping it balanced with respect to back and forth motion, owing to the parallel and slightly rearward inclined arrangement of the first and second guide rails 11 and 12 spaced at a relatively large distance D and the horizontally spaced arrangement of the first and second sliders 13A and 14A. As long as the first and second guide rails 11 and 12 are spaced apart at a sufficient distance, they may be disposed substantially vertically to keep the window glass 6 well balanced.

The distance F between the first slider 13A and first auxiliary sliders 13B or the second slider 14A and second auxiliary sliders 14B, which is an important design factor for improving the inward or outward inclination of the window glass 6, can be desirably sufficiently determined by setting a sufficiently large distance E between the first and second sliders 13A and 14A. Because of the first and second auxiliary sliders 13B and 14B separated from the first and second sliders 13A and 14A, respectively, at the sufficient distance F, the window glass 6 is effectively prevented from inclining inward or outward.

The fact apparent from the above is that the arrangement of the first slider 13A, which is a traction or leading slider, spaced horizontally above the second slider 14A allows to provide a large angle Θ (see FIG. 1) between a line L1 interconnecting the first and second sliders 13A and 14A and a line L2 along which the second slider 14A moves for whatever door design conditions may be required. Providing a large angle between the lines L1 and L2 allows the first and second guide rails 11 and 12 to be disposed spaced at a large distance D, thereby setting the distance E between the first and second sliders 13A and 14A so as to hold the window glass 6 well balanced and to thereby allow the window glass to move up and down with no inward or outward inclination and back and forth tilting.

Figure 10:
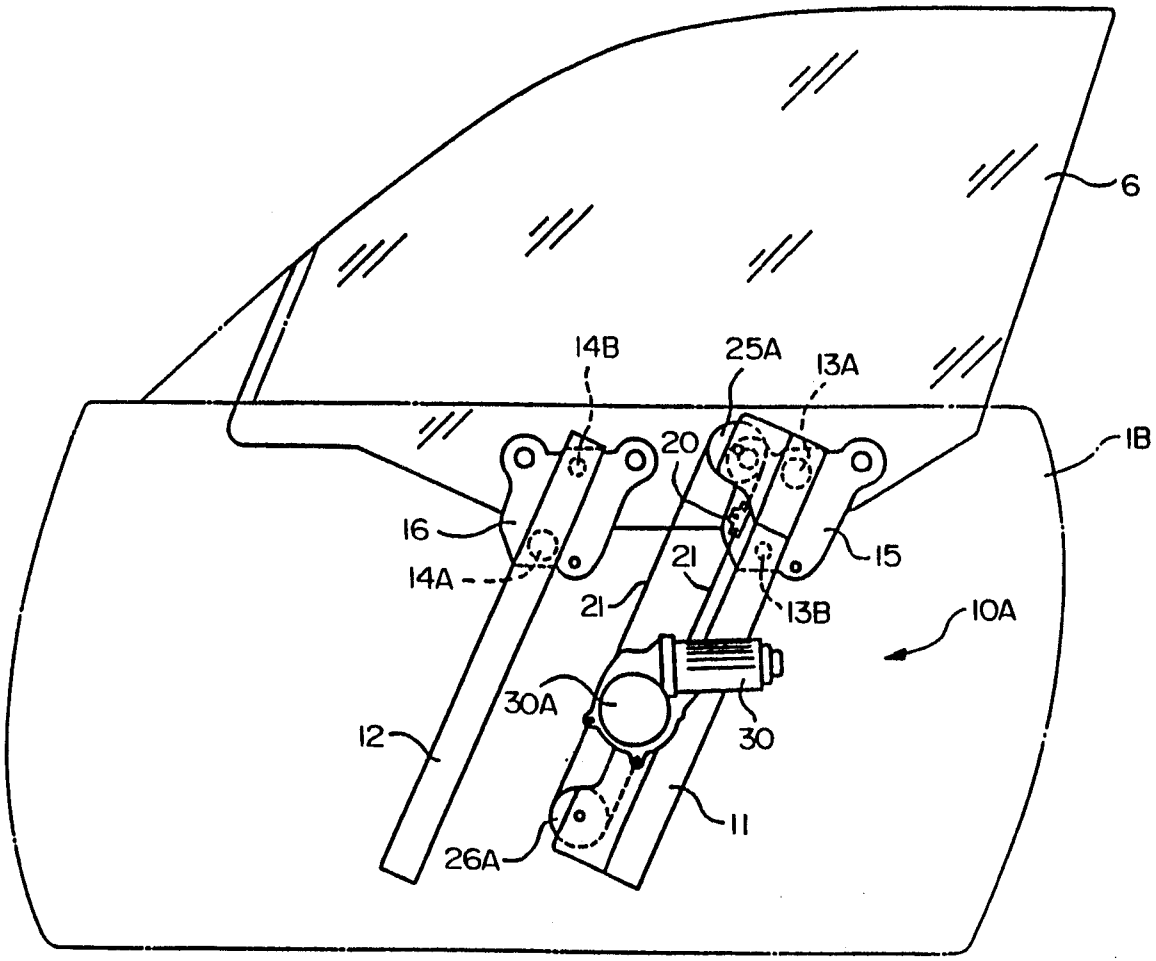
FIG. 10 is a schematic illustration, similar to FIG. 1, of a sashless front door of an automotive vehicle incorporating a window regulator in accordance with another preferred embodiment of the present invention.

FIG. 10 shows a sashless front door 1A of an automotive vehicle incorporating a window regulator 10A in accordance with another preferred embodiment of the present invention in which the electric motor 30 is mounted on the first guide rail 11 for improvement in assembly and compactness. As shown, the cable 21 connected to the cable retainer 20 is stretched between upper and lower pulleys 25A and 26A which are mounted on upper and lower end of the first guide rail 11 and having a diameter sufficiently large to avoid the cable from interfering with the electric motor 30.

Although the present invention has been fully described by way of the preferred embodiments thereof with reference to the accompanying drawings, it is to be noted that various changes and modifications are apparent to those skilled in the art. Therefore, unless such changes and modifications depart from the true scope and spirit of the present invention, they should be construed as included herein.

What is claimed is:

1. A window regulator for an automotive vehicle for moving a window glass up and down so as to open or close a window of a door of the automotive vehicle, said window regulator comprising:

first and second guide rails located in said door, each having an upper and a lower end, said guide rails being spaced apart, parallel to each other, and inclined so that their upper ends are located closer to a rear end of the automotive vehicle than their lower ends;

first and second brackets, each secured to said window glass and movable along said first and second guide rails, respectively, for movement between the upper and lower ends of said guide rails;

a traction slider and an auxiliary slider provided on each of said first and second brackets, each of said first and second brackets supporting only a single traction slider, each of said traction sliders being snugly received in its respective guide rail, each of said auxiliary sliders being loosely received in its respective guide rail, the traction slider provided on said first bracket located vertically above the traction slider provided on said second bracket, the auxiliary slider of said first bracket being located vertically below the auxiliary slider of said second bracket; and driving means for applying a driving force to said first bracket to move said first bracket, said second bracket and said window glass along said guide rails, said first and second brackets slidingly moving up or down along said guide rails to thereby move said window glass up or down so as to close or open said window of said door.

2. A window regulator as defined in claim 1, wherein said driving means comprises an electric motor and a cable connected to said first bracket.

3. A window regulator as defined in claim 1, wherein said driving means comprises a manually operated cable connected to said first bracket.

4. A window regulator as defined in claim 1, wherein said window regulator is mounted between inner and outer door panels of said automotive vehicle and further comprises adjusting means for changing the inclination of said window glass with respect to said inner and outer door panels during manufacture of said door.

5. A window regulator as defined in claim 4, wherein each of said first and second brackets comprises inner and outer bracket plates and said adjusting means comprises an adjusting screw extending between said inner and outer bracket plates, turning of said adjusting screw changing said inclination of said window glass.

* * * * *